United States Patent [19]

Chlystun

[11] 4,095,728

[45] Jun. 20, 1978

[54] CONTAINER WITH IMPROVED COLLAPSIBLE POURING SPOUT

[76] Inventor: Walter K. Chlystun, 327 St. James Dr., Spartanburg, S.C. 29301

[21] Appl. No.: 725,931

[22] Filed: Sep. 23, 1976

[51] Int. Cl.[2] ..... B67D 3/00

[52] U.S. Cl. ..... 222/529

[58] Field of Search ..... 222/530, 534, 535, 541, 222/529, 386.5; 220/67, 85 SP; 229/DIG. 3; 21/114, 124; 285/226; 138/119, 121; 417/472; 92/45, 34; 277/212 FR

[56] References Cited

U.S. PATENT DOCUMENTS

| | | | |
|---|---|---|---|
| 3,690,522 | 9/1972 | Chlystun | 222/529 |
| 3,721,371 | 3/1973 | Dolveck | 222/386.5 |
| 3,731,854 | 5/1973 | Casey | 222/386.5 |

*Primary Examiner*—Robert R. Song
*Assistant Examiner*—Norman L. Stack, Jr.
*Attorney, Agent, or Firm*—Wellington M. Manning, Jr.; Luke J. Wilburn, Jr.

[57] ABSTRACT

A dispensing container is disclosed herein with an improved collapsible pouring spout. The container, preferably a blow molded container, has at least one side wall with a nestable dispensing spout secured thereto. Most preferably a wall, top and spout are integral having been blow molded with a bottom being provided by way of a metal cap or the like and applied during the filling operation. Initially the pouring spout is nested within the container and is extractable to a dispensing position. The nestable dispensing spout has a bellows section therealong about which the spout partially everts from a nested to an extended position and vice versa, with the bellows section containing a series of progressively smaller pleats from bottom to top. At least certain of the pleats have circumferentially compressible sections therearound which may be protrusions, detents or both. The protrusions and/or detents permit a circumferential compression and thus a reduction of an outside or inside diameter of same, depending upon the type section that is employed. Partial eversion of the spout is thus fostered. A cover is secured to the top of the pouring spout and is removeable therefrom to permit dispensing. The cover may be adapted to be replaceable after removal from the spout to reclose and/or reseal same.

14 Claims, 8 Drawing Figures

CONTAINER WITH IMPROVED COLLAPSIBLE POURING SPOUT

BACKGROUND OF THE INVENTION

Development of the container art, at least insofar as containers for packaging of various and sundry liquids, has progressed in the direction of providing containers with pouring spouts as a part thereof. Certain of these containers are adapted with pouring spouts that are affixed to the container in some fashion to facilitate the dispensing of the contents from the container as disclosed in U.S. Pat. Nos. 3,298,577 and 3,690,522 to Chlystun.

In those containers that are provided with a pouring spout, the spout is generally resideable within the container, either by slideable recession or partial eversion of the spout. This application is directed to the spouts that partially evert or turn inside out to nest within the container. When needed, the spout is pulled outwardly to an extended, dispensing position. After withdrawal of the pouring spout, the opening means are separated from the spout whereby the contents of the container may be dispensed therethrough.

It has been determined with the partially evertible pouring spouts that some resistance can be encountered during the partial eversion for nesting and withdrawal. The present invention represents an improvement in the art in reducing the resistance during the partial eversion of the spout whereby an easier manipulation of the spout is available.

SUMMARY OF THE INVENTION

It is an object of the present invention to provide a container having an improved pouring spout in conjunction therewith.

A further object of the present invention is to provide an improved dispensing container for liquids having a partially eversible pouring spout nested therein and which is easily withdrawn for dispensing.

Yet another object of the present invention is to provide an improved blow molded container having a pouring spout associated therewith, the improvement being directed to the spout to foster ease of eversibility thereof.

Still another object of the present invention is to provide a container having an integral pouring spout with a bellows section therealong, said spout being easily nested within the container and easily withdrawable therefrom.

Generally speaking, the present invention relates to a dispensing container comprising a container body; a dispensing spout secured to said body, said dispensing spout having a bellows section therealong, said bellows section having a plurality of pleats, at least certain of the pleats having circumferentially compressible sections therearound, said sections upon compression causing a reduction of a diameter of said at least certain of the pleats to foster partial eversion of the spout.

More specifically, the present invention relates to a container for packaging and dispensing liquids such as oil, chemicals and the like, the container being self-contained, in that, a closed dispensing spout is nested within an end of the container which, when withdrawn, may be opened to dispense the contents of the container. The pouring or dispensing spout is partially everted within the container and during withdrawal or reversal of the side walls accomplished the eversion to an extended dispensing position. The spout has a bellows section along its length about which the eversion takes place with the bellows section being made up of a plurality of adjacent pleats, each upper pleat being smaller in diameter than the next adjacent lower pleat. At least certain of the pleats have circumferentially compressible sections, either projecting sections or detent sections therearound. Upon axial pulling or pushing, the compressible sections reduce the diameter of the pleat. Projecting sections, preferably in the form of a pyramid, reduce the inside diameter of the pleat, detent sections, also preferably in the form of a pyramid, reduce the outside diameter of the pleat. Ease of nesting and withdrawal of the spout is thus improved, particularly when the compressible sections are located around the top and bottom pleat. The dispensing spout may also be provided with a removeable cover that may be employed to reclose and/or reseal the container after opening. Also the cover may be hingedly secured to one side of the spout such that only partial removal of the cover is effected to dispense the contents of the container.

DESCRIPTION OF THE PREFERRED EMBODIMENTS

Figure 1:
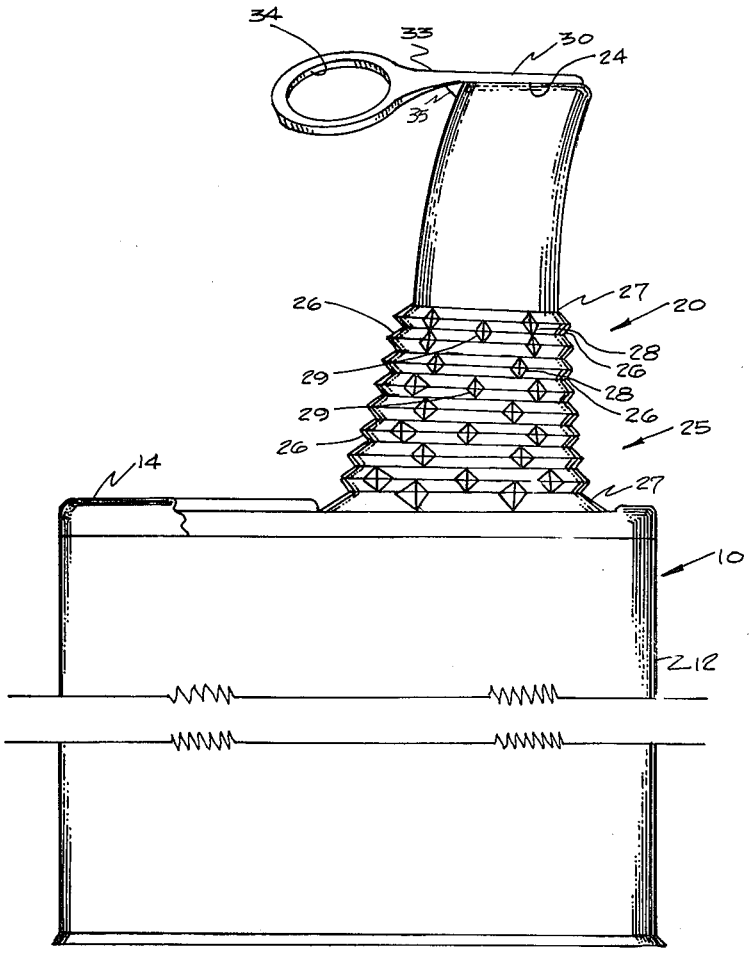
FIG. 1 is a partial elevational view of a container with an improved dispensing spout according to the teachings of the present invention.
Figure 2:
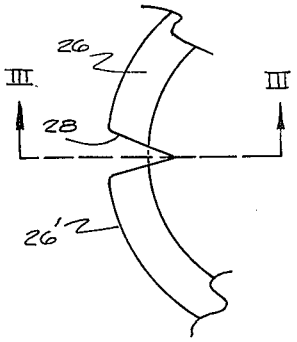
FIG. 2 is a top view of a portion of a pleat of the bellows section of a dispensing spout illustrating a circumferentially compressible detent section therein.
Figure 3:
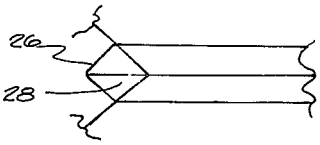
FIG. 3 is a partial side cross sectional view of the pleat of FIG. 2, taken along a line III—III.
Figure 4:
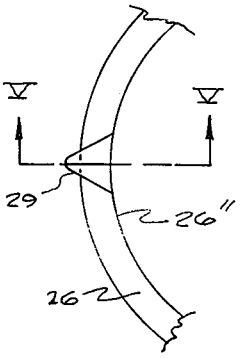
FIG. 4 is a top view of a portion of a further pleat of the bellows section of a dispensing spout illustrating a circumferentially compressible projecting section thereon.
Figure 5:
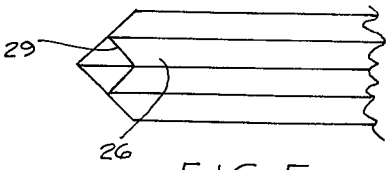
FIG. 5 is a partial side cross sectional view of the pleat of FIG. 4, taken along a line V—V.
Figure 6:
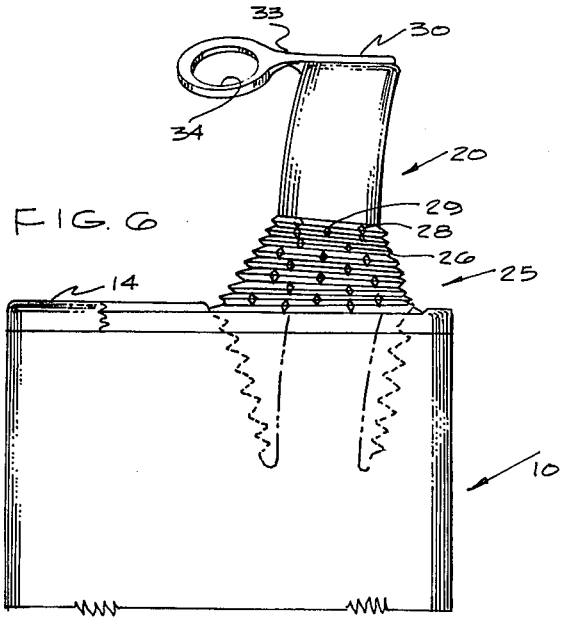
FIG. 6 is a partial side elevational view of a container as illustrated in FIG. 1 and illustrating the dispensing spout in a partially collapsed position.

Making reference to the Figures, preferred embodiments of the present invention will now be described in detail. In FIGS. 1 and 6, a container generally indicated as 10 is shown having body walls 12 and a top wall 14. Top wall 14 is provided with a pouring spout generally indicated as 20 shown secured thereto, and preferably of unitary construction therewith. Pouring spout 20 is also shown in phantom in FIG. 6 as being nestable within container 10. Spout 20 has a cover 30 secured to the top thereof with a tear line 24 therebetween to facilitate removal of cover 30. Cover 30 has a laterally extending portion 33 having an opening 34 to receive a finger or the like therein. As such, one can grasp cover 30 at opening 34 and lift upwardly, withdrawing spout 20 from its nested position within container 10 to an extended, dispensing position. Cover 30 may then be torn from spout 20 by a continued pulling motion, separation first occurring at a vent producing element 35 and continuing along tear line 24. In certain containers the tear line 24 may be omitted, whereby it becomes necessary to simply cut cover 30 from spout 20 after spout 20 is withdrawn from its nested position. Moreover, cover 30 can be designed to be replaceable on spout 20 after removal to reclose and/or reseal container 10 as more particularly described hereinafter, or may be only partially removeable, being held on spout 20 by a hinge means.

Spout 20 as illustrated in FIGS. 1 and 6 has a bellows section generally indicated as 25 which is made up of a plurality of pleats 26 and which will collapse in accordion fashion when a downward force is applied on spout 20 (See FIG. 6). The downward force would be applied to cause a partial eversion of spout 20 about bellows section 25 to assume a nested position within container 10 as shown in phantom in FIG. 6. Under normal circumstances such action takes place with some difficulty and may cause stress areas in spout 20, depending upon shape of the spout, wall thickness, and flexibility of the material from which spout 20 is produced. Such stress areas generally occur at the top and bottom of the bellows section, identified as 27. Likewise, upon withdrawal of spout 20 from its nested position, a like stress experience is encountered. The difficulty experienced occurs during the partial eversion of part of spout 20, where the pleats must reverse and pass at least partially through the next adjacent larger pleat, both during collapse and withdrawal. While this means of eversion does work, as mentioned above, some difficulty may be experienced.

As more clearly illustrated in FIGS. 2 through 5, pleats 26 of bellows section 25 are provided at least in part with means to vary the diameters of same upon receipt of axial pressure to foster movement of smaller pleats through next adjacent larger pleats. At least certain of the pleats may have circumferentially compressible detent sections 28, located therearound, preferably in pyramidal form, though other forms are acceptable, compression of which lessens the outside diameter 26' of the particular pleats 26 on which they are located. Likewise, certain of pleats 26 may be provided with circumferentially compressible projecting sections 29 located therearound, also preferably of pyramidal form, compression of which reduces the inside diameter 26'' of the pleats 26 on which they are located. In a preferred embodiment, both detent sections 28 and projecting section 29 are pyramidal shaped, and both are employed around the same or different pleats. In a most preferred situation, compressible sections are disposed around the upper and lowermost pleats at least.

Upon compression of the spout, dimensional changes of the inside and/or outside diameters of the pleats occurs where the compressible sections are provided, whereby ease of partial eversion of the dispensing spout occurs.

It is not necessary to provide compressible sections on every pleat, though in a preferred embodiment, a majority of the pleats are so equipped. Likewise, placement of the detent sections with respect to the projecting sections is not critical around the circumference of a pleat, though in a preferred arrangement, the sections are equally spaced around the circumference of the pleats and are circumferentially offset from opposite types of compressible sections.

Figure 7:
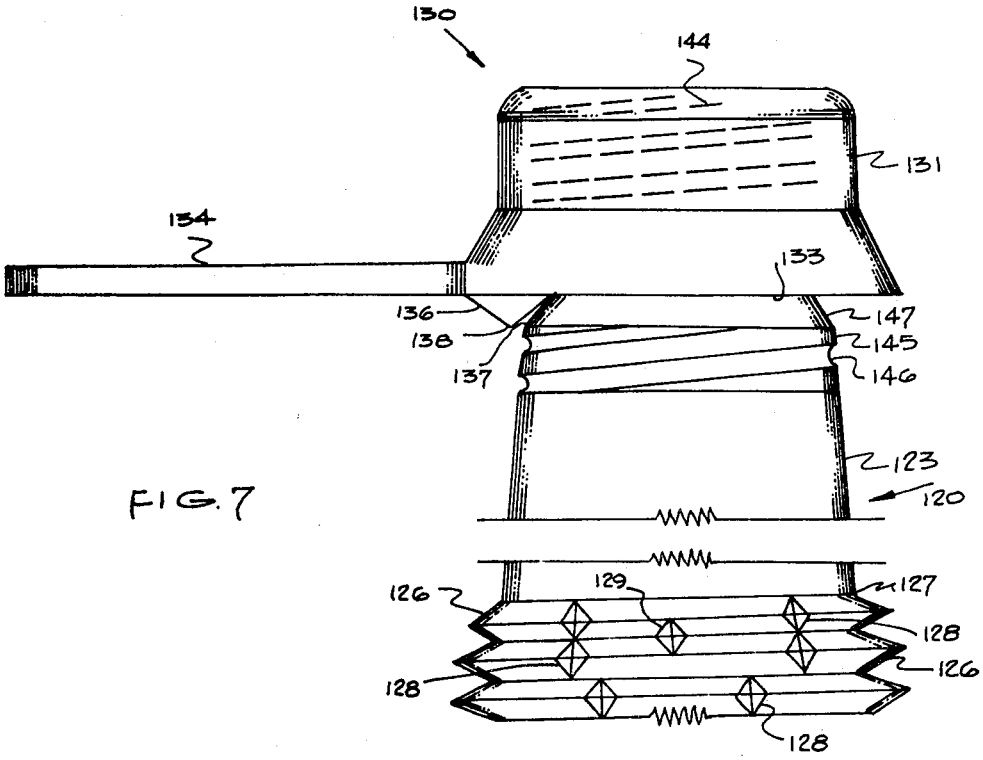
FIG. 7 is a partial side elevational view of a dispensing spout according to the present invention, illustrating a further embodiment of same.
Figure 8:
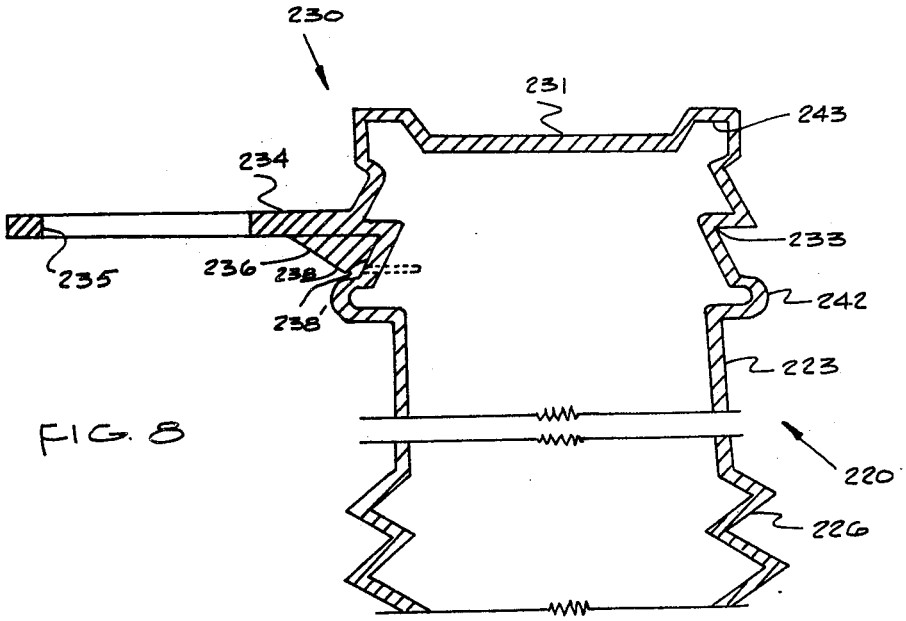
FIG. 8 is a partial side elevational view of a dispensing spout according to the present invention, illustrating a further embodiment of same.

Reference is further made to FIGS. 7 and 8 wherein exemplary reclose and/or reseal covers for dispensing spouts of the present invention are generally described. Note, for example, in FIG. 7 a threaded cap with a mating threaded portion along a forward end 123 of a spout 120. Cap 131 thus has projections 144 extending inwardly from the cap walls that will matingly fit with lads and grooves 145 and 146 respectively, along the forward end 123 of spout 120 after cap 131 has been removed and is replaced on spout 120. Adjacent weakened tear area 133, a tapered section 147 exists prior to the threaded section on spout 120. Tapered section 147 has a vent area 136 thereat. A strip of material 137 extends between vent area 136 and an underside of withdrawal tab 134. Strip 137 preferably has an undercut portion 138 adjacent vent area 136 to assist in initiation of rupture at vent area 136. With the above arrangement, an upward movement of withdrawal means 134 will cause a rupture at vent area 136. Thereafter a separation will occur at first weakened tear area 133 between cap 131 and section 147 of spout 120. Cap 131 may thus be replaced on the forward end 123 of spout 120 and threadedly secured thereto in conventional fashion.

In FIG. 8, a snap fit reseal arrangement is shown wherein a cap 231 has an annular ring 243 received therein. Forward end 223 of spout 220 is provided with an enlarged projection 242 around a portion thereof adjacent a first weakened tear area 233 with a tapered section 247 therebetween. Likewise, a vent producing area 236 is provided on spout 220 at section 247, extending in a circumferential direction therearound. A strip of material 237 connects the underside of withdrawal means 234 to vent area 236. Vent producing area 236 likewise has an undercut 238 as was previously described earlier, whereupon, an upward movement of withdrawal 234 by engagement, for example, in finger receiving opening 235 will cause a rupture along vent area 236 in a circumferential direction. If first tear area 233 is connected to vent area 236, first weakened tear area 233 will rupture after production of vent 236 to permit removal of the cap 231 from spout 220. Thereafter, when it becomes desirable to reclose or reseal the container, cap 231 can be replaced over the upper end 223 of spout 220 such that the annular ring 243 receives enlarged section 242 in a reclosed or resealed engagement therewith.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. An improved dispensing container comprising:

(a) a body; and (b) a dispensing spout secured to said body and being nestable within said body, said spout including a tapered portion extending outwardly from said body and having a plurality of circumferential pleats therealong whereby said tapered portion of said spout partially everts during nesting and withdrawal of said spout, at least one of said circumferential pleats including at least one means located along the circumference of same that extends generally radially with respect thereto, said at least one means being circumferentially compressible during eversion of said spout to circumferentially reduce said at least one pleat to facilitate nesting and withdrawal of said spout.

2. The container as defined in claim 1 wherein said body and said spout are of unitary construction.

3. The container as defined in claim 1 wherein said means are compressible sections that project from said pleat and reduce an inside diameter of said pleat during compression.

4. The container as defined in claim 1 wherein said means are compressible sections that are detents and reduce an outside diameter of said pleat during compression.

5. The container as defined in claim 1 wherein certain pleats have means that are compressible projecting sections and certain pleats have means that are compressible detent sections.

6. The container as defined in claim 5 wherein the compressible means are equally spaced around the pleats.

7. The container as defined in claim 1 wherein said spout has a removable cover thereon.

8. The container as defined in claim 7 wherein the cover is replaceable over an end of said spout to reclose said spout.

9. An improved dispensing container comprising:

(a) a body;

(b) a top wall integral with said body; and (c) a dispensing spout integral with said top wall and including a tapered, circumferentially pleated portion extending outwardly from said top wall whereby application of axial force along said spout to nest or withdraw said spout causes eversion of the tapered spout portion, at least one of said pleats having at least one means around the circumference thereof that extends generally radially with respect thereto, said at least one means being circumferentially compressible during eversion of said spout to circumferentially reduce said at least one pleat to facilitate nesting and withdrawal of said spout.

10. The container as defined in claim 9 wherein said means are compression sections that are projections from said at least certain of said pleats.

11. The container as defined in claim 10 wherein the projections are pyramidal shaped.

12. The container as defined in claim 9 wherein said means are compression sections that are detents into said at least certain of said pleats.

13. The container as defined in claim 12 wherein the detent sections are pyramidal shaped.

14. The container as defined in claim 9 wherein certain of said pleats have means that are compressible projecting sections and certain of said pleats have means that are compressible detent sections.

* * * * *